US010931043B2

(12) United States Patent
Ho

(10) Patent No.: US 10,931,043 B2
(45) Date of Patent: Feb. 23, 2021

(54) ELECTRICAL CONNECTOR

(71) Applicant: LOTES CO., LTD, Keelung (TW)

(72) Inventor: Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/819,332

(22) Filed: Mar. 16, 2020

(65) Prior Publication Data

US 2020/0313321 A1 Oct. 1, 2020

(30) Foreign Application Priority Data

Mar. 29, 2019 (CN) ..... 201910249163.6

(51) Int. Cl.
*H01R 12/58* (2011.01)
*H01R 13/24* (2006.01)

(52) U.S. Cl.
CPC ..... *H01R 12/585* (2013.01); *H01R 13/2442* (2013.01)

(58) Field of Classification Search
CPC .... H01R 23/722; H01R 9/096; H01R 12/585; H01R 13/2442
USPC ..... 439/66
See application file for complete search history.

(56) References Cited

U.S. PATENT DOCUMENTS 6,688,893 B1 * 2/2004 Huang ..... H01R 12/57 439/66
7,114,959 B2 10/2006 Stone et al.
7,815,440 B2 * 10/2010 Hsieh ..... H01R 13/2421 439/66
7,862,343 B1 * 1/2011 Lin ..... H01R 13/2435 439/66
2010/0291774 A1 * 11/2010 Cheng ..... H01R 13/2435 439/66
2011/0171839 A1 * 7/2011 Yang ..... H01R 13/2421 439/66

FOREIGN PATENT DOCUMENTS

CN 2687871 Y 3/2005
CN 2735594 Y 10/2005
CN 202067956 U 12/2011
CN 101803128 B 12/2012
CN 202930669 U 5/2013
(Continued)

*Primary Examiner* — Gary F Paumen
(74) *Attorney, Agent, or Firm* — Locke Lord LLP; Tim Tingkang Xia, Esq.

(57) ABSTRACT

An electrical connector includes a substrate provided with an accommodating hole, and a first terminal and a second terminal provided vertically. The first terminal has a first elastic arm located outside the accommodating hole, and a first fixing portion retained in the accommodating hole. A plate surface of the first fixing portion forms a first laminated surface. The first elastic arm and the first laminated surface are located at two opposite sides of the first fixing portion. The second terminal has a second elastic arm located outside the accommodating hole, and a second fixing portion retained in the accommodating hole. A plate surface of the second fixing portion forms a second laminated surface parallel to and laminated with the first laminated surface along a horizontal direction. The second elastic arm and the second laminated surface are located at a same side of the second fixing portion.

13 Claims, 23 Drawing Sheets

(56) References Cited

FOREIGN PATENT DOCUMENTS

| | | | |
|---|---|---|---|
| CN | 203103592 | U | 7/2013 |
| CN | 205212010 | U | 5/2016 |
| CN | 107742787 | A | 2/2018 |
| CN | 108306126 | A | 7/2018 |
| CN | 108695612 | A | 10/2018 |
| CN | 208045744 | U | 11/2018 |

* cited by examiner

A-A

B–B

C–C

D–D

E-E

F–F

G–G

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201910249163.6 filed in China on Mar. 29, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector with good high-frequency performance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

The Chinese Patent No. CN20181027361.6 discloses an electrical connector, which is used to electrically connect a chip module. The electrical connector includes a shell, provided with a through hole running through a surface and a back surface thereof, and an inner wall surface of the through hole is plated with a conductive material. A first conductive pad and a second conductive pad are provided on a first surface and second surface of the shell respectively and in communication with the conductive material of the through hole. A first contact member is accommodated in the through hole and provided on the first surface of the shell. The first contact member has a first junction portion electrically connected to a first contact pad, a first insertion portion inserted into the through hole to be pressed on the inner wall surface of the through hole and elastically deformed, and a first connecting portion soldered to the first conductive pad. A second contact member is accommodated in the through hole and provided on the second surface of the shell. The second contact member has a second junction portion electrically connected to a second contact pad, a second insertion portion inserted into the through hole to be pressed on the inner wall surface of the through hole and elastically deformed, and a second connecting portion soldered to the second conductive pad. Both of the first contact member and the second contact member are in contact with the conductive material of the inner wall surface of the through hole to implement electrical conduction.

However, the first insertion portion and the second insertion portion are separated from each other, and are in contact with the conductive material of the inner wall surface of the through hole respectively to implement mutual electrical conduction. Each of the first insertion portion and the second insertion portion is shaped like a pinhole, that is, having a wide middle portion and two narrow ends. Only a relatively wide section of the middle portion is in contact with the conductive material for conduction, and a relatively narrow section of the lower end is not in contact with the conductive material, such that the first contact member and the second contact member may have an open stub effect to affect high-frequency performance during high-frequency signal transmission. In addition, the first junction portion and the second junction portion are located at two opposite sides of the through hole respectively, such that a gap between two adjacent through holes along an arrangement direction of the first junction portion and the second portion may be relatively large, and dense arrangement of the contact members is affected.

Therefore, a heretofore unaddressed need to design a novel electrical connector exists in the art to address the aforementioned deficiencies and inadequacies.

SUMMARY

The present invention is directed to an electrical connector with good high-frequency performance and densely arranged.

To achieve the foregoing objective, the present invention adopts the following technical solutions.

An electrical connector is configured to electrically connect a first mating component to a second mating component. The electrical connector includes: a substrate, provided with an accommodating hole; a first terminal, having a first elastic arm located outside the accommodating hole and abutting the first mating component along a vertical direction, and a first fixing portion retained in the accommodating hole, wherein a plate surface of the first fixing portion forms a first laminated surface, and the first elastic arm and the first laminated surface are located at two opposite sides of the first fixing portion; and a second terminal, provided vertically with the first terminal, wherein the second terminal has a second elastic arm located outside the accommodating hole and abutting the second mating component along the vertical direction, and a second fixing portion retained in the accommodating hole, a plate surface of the second fixing portion forms a second laminated surface parallel to the first laminated surface, the second laminated surface is laminated with the first laminated surface along a horizontal direction, and the second elastic arm and the second laminated surface are located at a same side of the second fixing portion.

In certain embodiments, a first flat plate portion extends from the first fixing portion and is located outside the accommodating hole, the first fixing portion and the first flat plate portion are located on a same plane, one end of the first flat plate portion forms a first strip connecting end to be connected to a first strip, a first bending portion is formed by bending from one of two opposite sides of the first flat plate portion, and the first elastic arm extends from the first bending portion toward the other of the two opposite sides of the first flat plate portion; and a second flat plate portion extends from the second fixing portion and is located outside the accommodating hole, the second fixing portion and the second flat plate portion are located on a same plane, one end of the second flat plate portion forms a second strip connecting end to be connected to a second strip, a second bending portion is formed by bending from one of two opposite sides of the second flat plate portion, the second elastic arm extends from the second bending portion toward the other of the two opposite sides of the second flat plate portion, and an extending direction of the first elastic arm and an extending direction of the second elastic arm are identical.

In certain embodiments, the first elastic arm and the first flat plate portion partially overlap with each other in the horizontal direction, and a first reserve slot is formed at the side of the first flat plate portion connected with the first bending portion to reserve for the first elastic arm.

In certain embodiments, the first strip connecting end is located right above the first fixing portion, and a width of the first strip connecting end right above the first fixing portion is greater than a maximum width of the first fixing portion.

In certain embodiments, the first fixing portion is provided with a first through hole running through a thickness direction of the first fixing portion, the first through hole partially extends out of the accommodating hole, the first flat plate portion is provided with a first through slot located between the first through hole and the first bending portion, and a height of the first through hole, a height of the first through slot and a height of the first bending portion partially overlap with one another.

In certain embodiments, both of the first fixing portion and the second fixing portion are in interference fit with the accommodating hole, the first fixing portion is provided with a first through hole running through a thickness direction of the first fixing portion, the second fixing portion is provided with a second through hole running through a thickness direction of the second fixing portion, and the first through hole and the second through hole are in communication with each other.

In certain embodiments, the first fixing portion is further provided with a first notch in communication with the first through hole and running through a side edge of the first fixing portion, the second fixing portion is further provided with a second notch in communication with the second through hole and running through a side edge of the second fixing portion, and the first notch and the second notch are provided vertically and located at a same side of the first through hole.

In certain embodiments, the first fixing portion comprises two first branches, a first gap is formed between the two first branches, the second fixing portion comprises two second branches, a second gap is formed between the two second branches, and the first gap and the second gap are in communication with each other.

In certain embodiments, the electrical connector includes a plurality of first terminals, wherein the first terminals comprise a plurality of signal terminals and a plurality of ground terminals, the substrate is a circuit board and is provided with a plurality of accommodating holes comprising a plurality of signal accommodating holes accommodating the signal terminals and a plurality of ground accommodating holes accommodating the ground terminals, inner walls of the signal accommodating holes and inner walls of the ground accommodating holes have conductive layers respectively in contact with the signal terminals and the ground terminals correspondingly, a surface of the circuit board has a metal layer being grounded, the metal layer is electrically connected with the conductive layers of the inner walls of the ground accommodating holes, and the surface of the circuit board has an isolation slot surrounding the signal accommodating holes to electrically isolate the conductive layers of the inner walls of the signal accommodating holes from one another.

In certain embodiments, the electrical connector includes a plurality of first terminals, wherein the first terminals comprise a plurality of power terminals, the substrate is provided with a plurality of accommodating holes, inner walls of the accommodating holes in which the power terminals are located have conductive layers respectively in contact with the power terminals correspondingly, the substrate has a metal layer, and the metal layer is electrically connected with the conductive layers of the inner walls of the accommodating holes in which the power terminals are located.

In certain embodiments, the substrate is a circuit board, two opposite surfaces of the substrate respectively have a first metal layer and a second metal layer, an inner wall of the accommodating hole is provided with a conductive layer connected with the first metal layer and the second metal layer, a first abutting arm is formed from the first elastic arm to abut the first metal layer, and a second abutting arm is formed from the second elastic arm to abut the second metal layer.

In certain embodiments, the first fixing portion and the second fixing portion are located at two opposite sides of a vertical center plane of the accommodating hole.

In certain embodiments, the first fixing portion and the second fixing portion have different widths, and a virtual center line of the accommodating hole passes through one of the first fixing portion and the second fixing portion.

Compared with the related art, the electrical connector according to certain embodiments of the present invention has the following beneficial effects.

A plate surface of the first fixing portion forms the first laminated surface, a plate surface of the second fixing portion forms the second laminated surface parallel to the first laminated surface, and the second laminated surface is laminated with the first laminated surface along the horizontal direction, such that an open stub effect during high-frequency signal transmission of the first terminal and the second terminal may be resolved, and the electrical connector is endowed with good high-frequency performance. The first elastic arm and the first laminated surface are located at two opposite sides of the first fixing portion, and the second elastic arm and the second laminated surface are located at the same side of the second fixing portion. That is, the first elastic arm and the second elastic arm are located at the same side as the first laminated surface, such that a distance between the first elastic arm and the second elastic arm in the horizontal direction is relatively short, thereby allowing two adjacent first terminals to be arranged more densely, and two adjacent second terminals to be arranged more densely.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
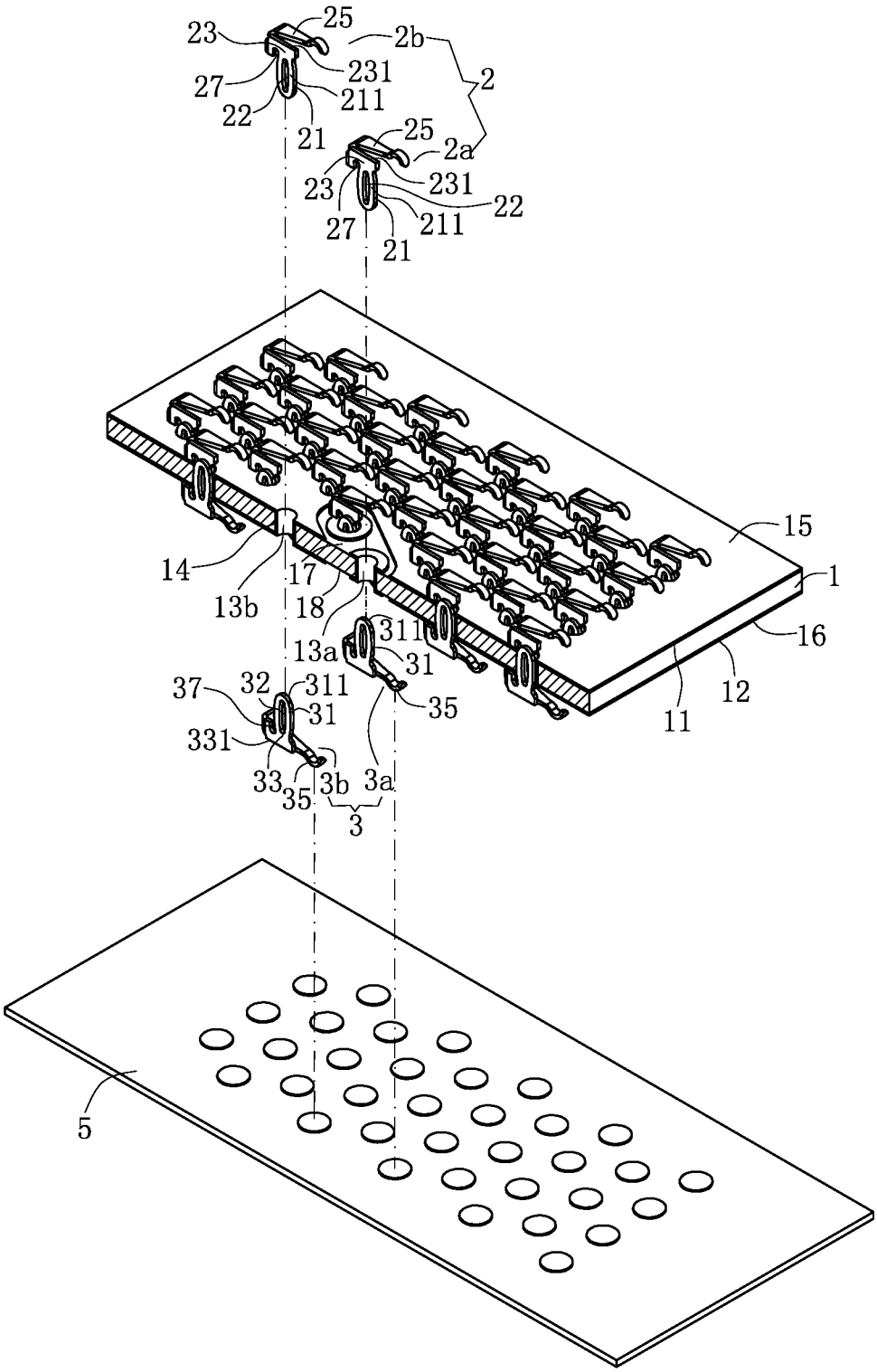
FIG. 1 is a partial perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-23. In accordance with the purposes of this invention, as embodied and broadly described herein, this invention, in one aspect, relates to an electrical connector.

FIG. 1 to FIG. 8 show an electrical connector 100 according to a first embodiment of the present invention. The electrical connector 100 is configured to electrically connect a first mating component (not shown in the figures) to a second mating component 5, and includes a substrate 1, and multiple first terminals 2 and multiple second terminals 3 accommodated in the substrate 1. In the present embodiment, the first mating component is a chip module, the second mating component 5 is a main circuit board, the first terminals 2 are located above, and the second terminals 3 are located below. In other embodiments, the first terminals 2 may also be located below, and the second terminals 3 may be located above. Alternatively, there may be only one first terminal 2 and one second terminal 3.

Figure 2:
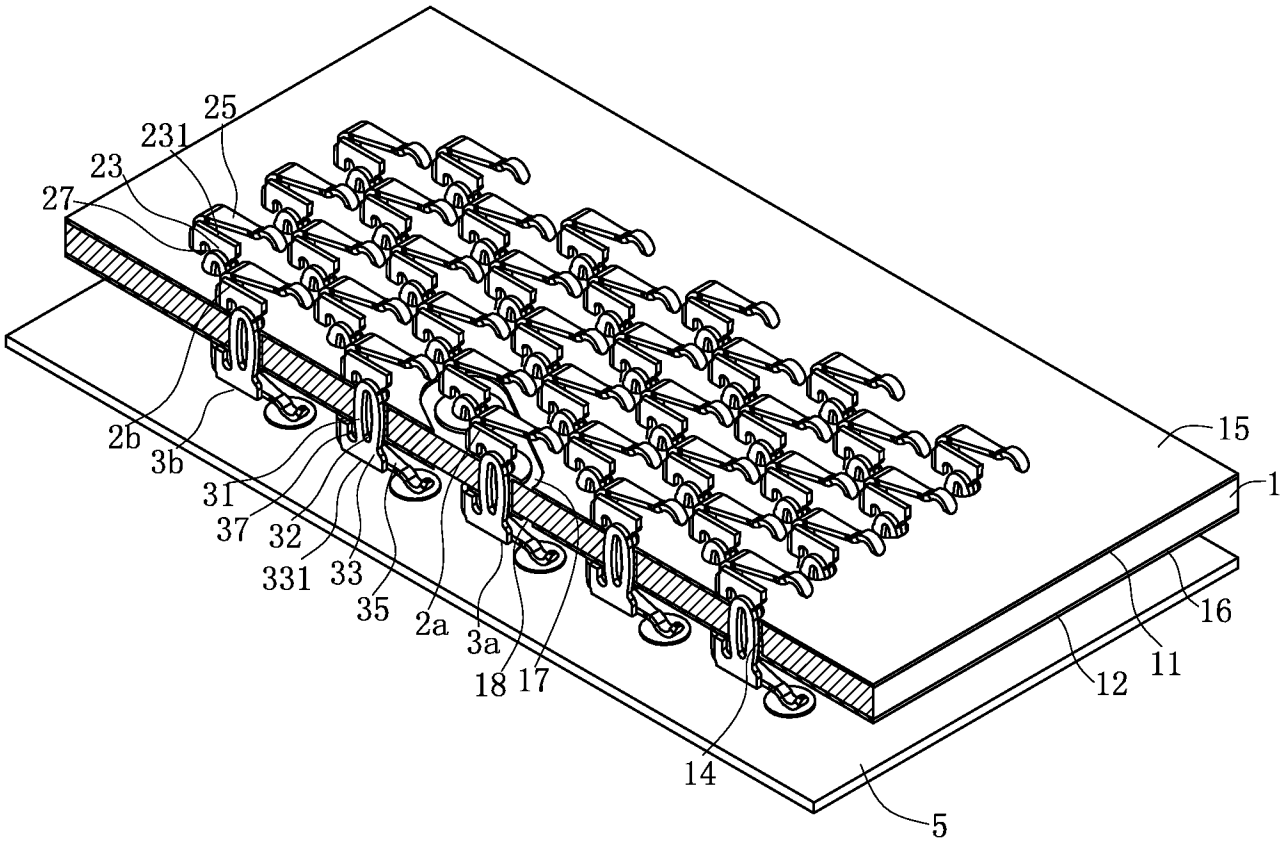
FIG. 2 is a partial perspective assembly view of the electrical connector according to the first embodiment of the present invention.
Figure 3:
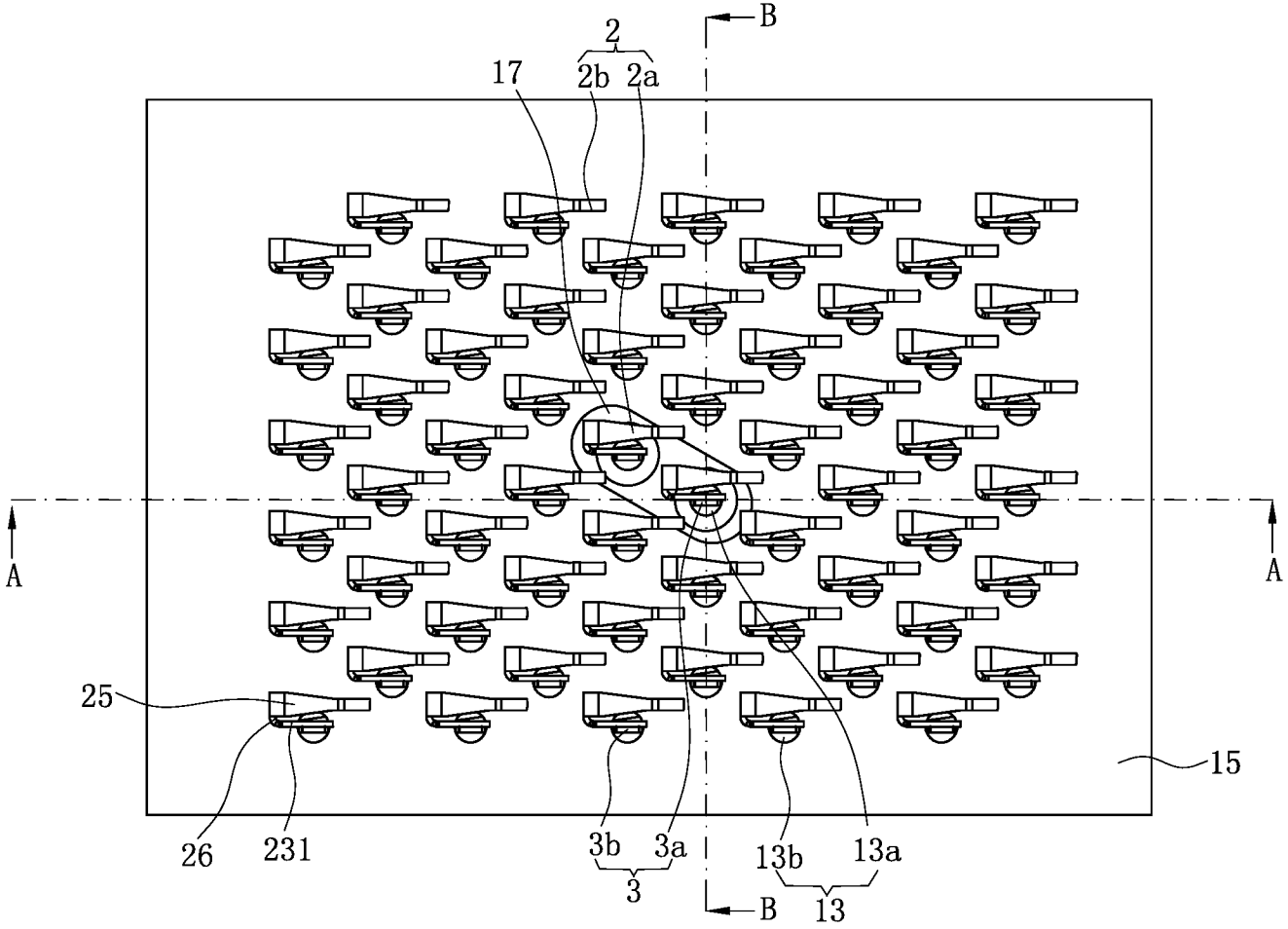
FIG. 3 is a top view of the electrical connector according to the first embodiment of the present invention.

As shown in FIG. 1 to FIG. 3, in the present embodiment, the substrate 1 is a circuit board. The substrate 1 has an upper surface 11 and a lower surface 12 provided opposite to each other. The substrate 1 is provided with multiple accommodating holes 13 running through the upper surface 11 and the lower surface 12 in a vertical direction, and the accommodating holes 13 are round holes. An inner wall of each accommodating hole 13 is provided with a conductive layer 14. The upper surface 11 is provided with a first metal layer 15, and the lower surface 12 is provided with a second metal layer 16.

One first terminal 2 and one second terminal 3 are accommodated in each accommodating hole 13.

Figure 4:
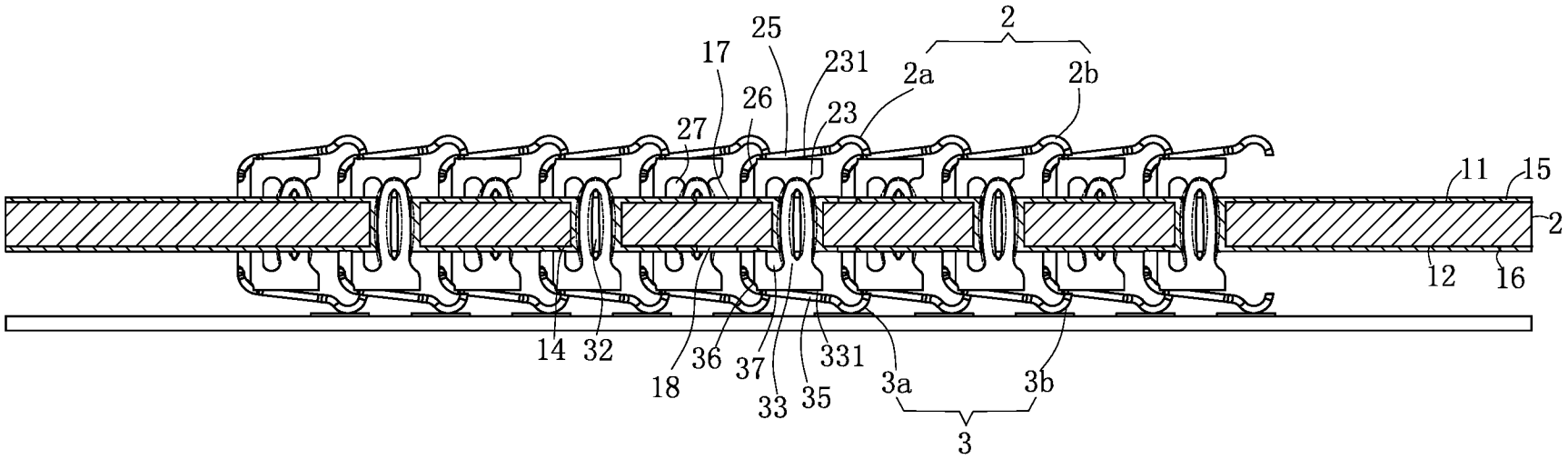
FIG. 4 is a sectional view of FIG. 3 along line A-A.
Figure 6:
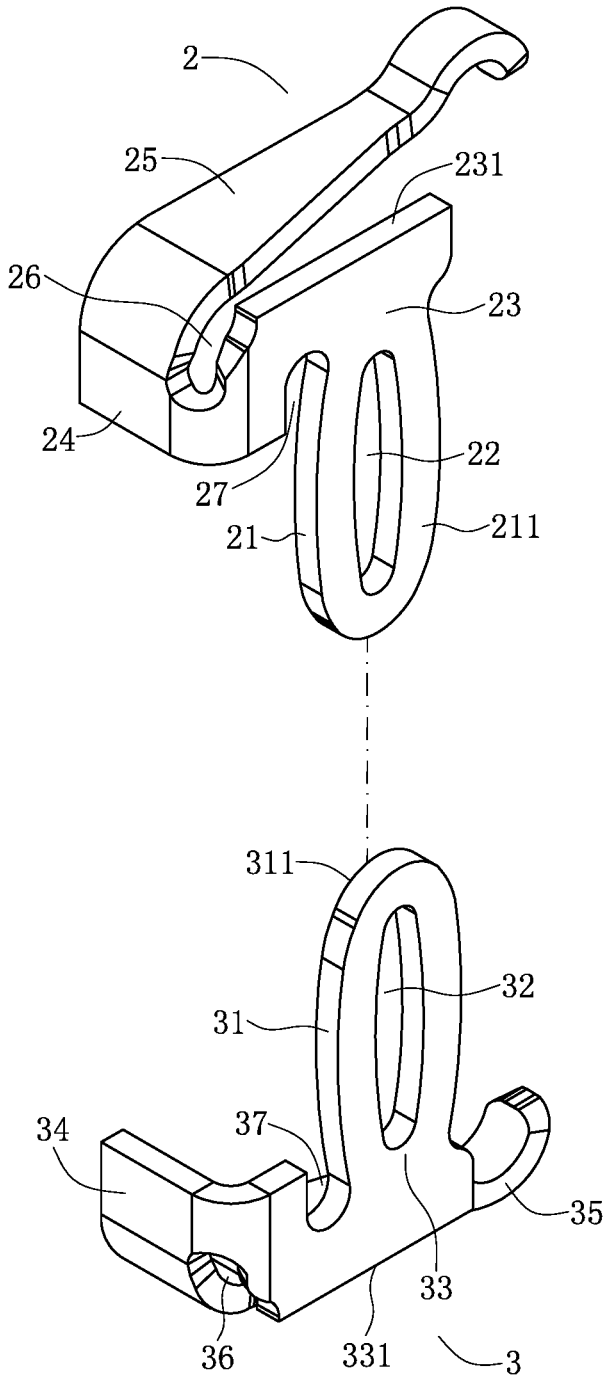
FIG. 6 is a perspective exploded view of a first terminal and a second terminal of the electrical connector according to the first embodiment of the present invention.
Figure 7:
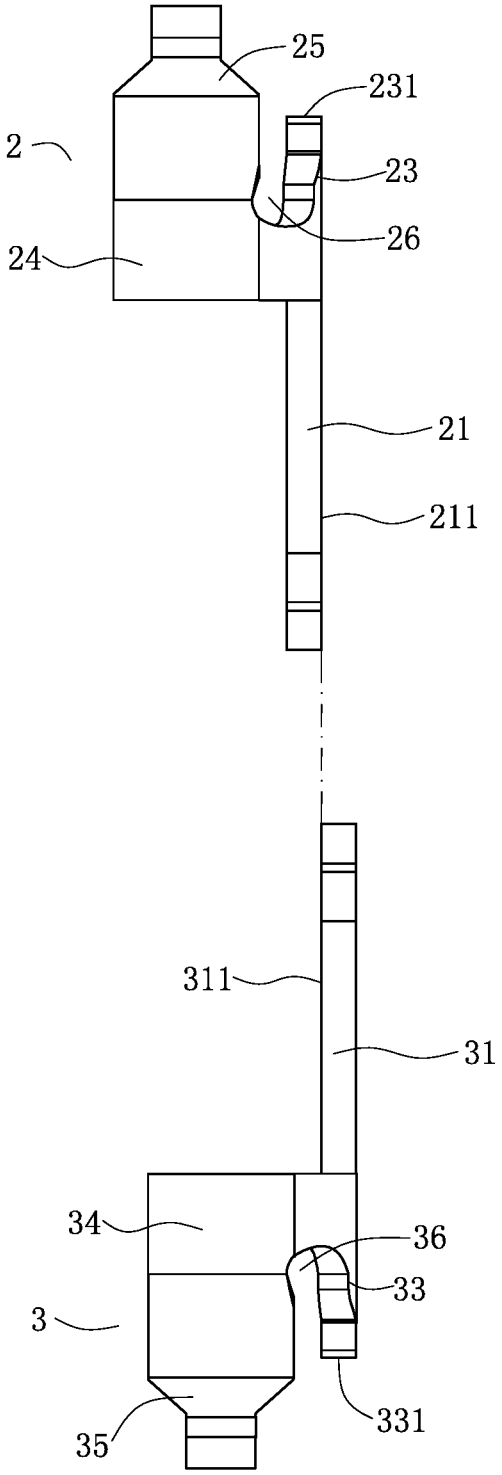
FIG. 7 is a side view of FIG. 6.
Figure 8:
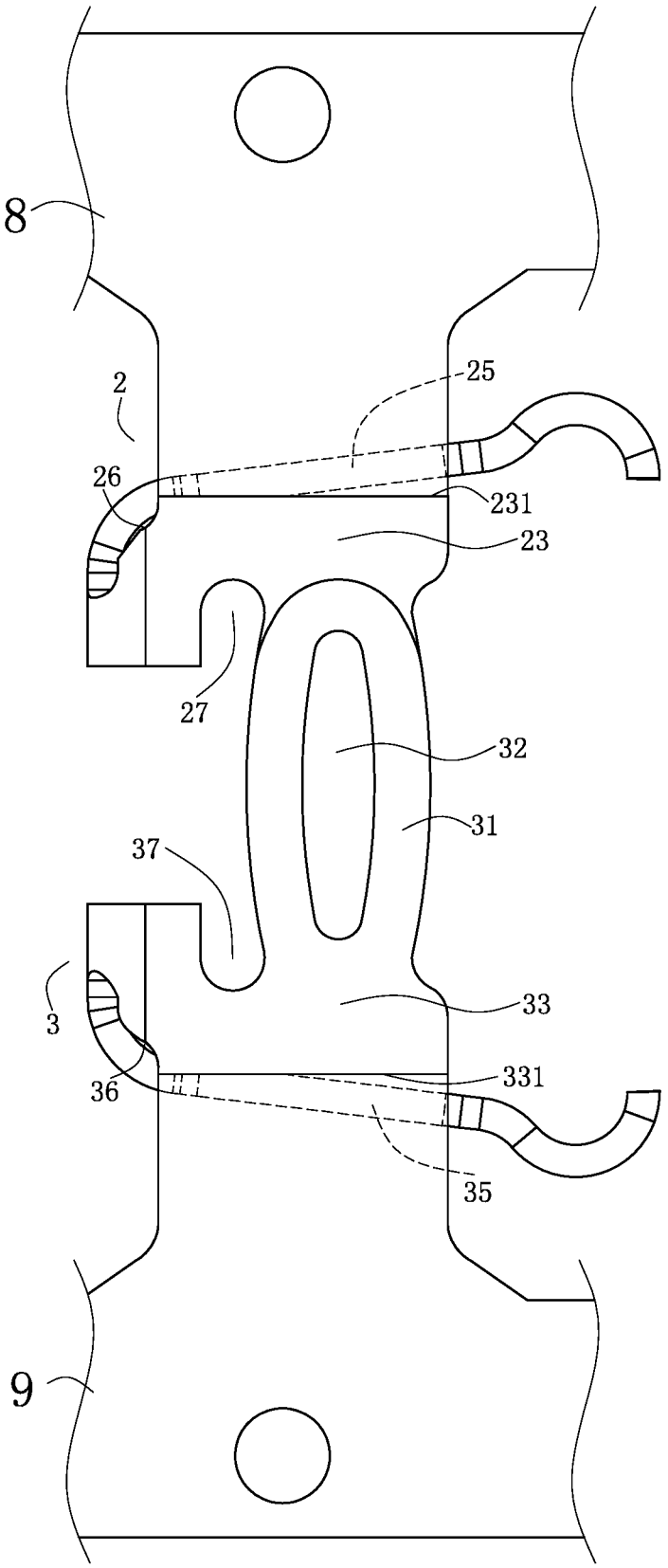
FIG. 8 is an assembly view of the first terminal and second terminal of the electrical connector according to the first embodiment of the present invention.

As shown in FIG. 4, FIG. 6 and FIG. 8, each first terminal 2 has a first fixing portion 21 located in the corresponding accommodating hole 13. The first fixing portion 21 is in contact with the conductive layer 14. A maximum width of the first fixing portion 21 is greater than a diameter of the corresponding accommodating hole 13 such that the first fixing portion 21 is in interference fit with the corresponding accommodating hole 13 to retain the first terminal 2 in the corresponding accommodating hole 13. A front plate surface of the first fixing portion 21 forms a first laminated surface 211. A first through hole 22 runs through a thickness direction of the first fixing portion 21 in a front-rear direction, that is, the first through hole 22 runs through front and rear plate surfaces of the first fixing portion 21, thus improving elasticity of the first fixing portion 21. The first through hole 22 is partially out of the corresponding accommodating hole 13 to be exposed on the upper surface 11 and the lower surface 12. A first flat plate portion 23 extends upward from the first fixing portion 21 and is located above the corresponding accommodating hole 13, and the first fixing portion 21 and the first flat plate portion 23 are located on a same plane. An upper end of the first flat plate portion 23 forms a first strip connecting end 231 to be connected to a first strip 8. The first strip connecting end 231 is located right above the first fixing portion 21, and a width of the first strip connecting end 231 right above the first fixing portion 21 is greater than the maximum width of the first fixing portion 21. A first bending portion 24 is formed by bending backward from a left side of the first flat plate portion 23. The first bending portion 24 is located above the upper surface 11. A first elastic arm 25 is formed by extending from the first bending portion 24 toward a right side of the first flat plate portion 23, such that the first laminated surface 211 and the first elastic arm 25 are located respectively at a front side and a rear side of the first fixing portion 21. The first elastic arm 25 is located outside the corresponding accommodating hole 13, and upward abuts the first mating component. The first elastic arm 25 and the first flat plate portion 23 partially overlap with each other in the front-rear direction. A first reserve slot 26 is formed at one side (i.e., the left side) of the first flat plate portion 23 connected with the first bending portion 24 to be reserved for the first elastic arm 25. The first flat plate portion 23 is provided with a first through slot 27 located between the first through hole 22 and the first bending portion 24 to improve elasticity of the first elastic arm 25. A height of the first through hole 22, a height of the first through slot 27 and a height of the first bending portion 24 partially overlap with one another.

Figure 5:
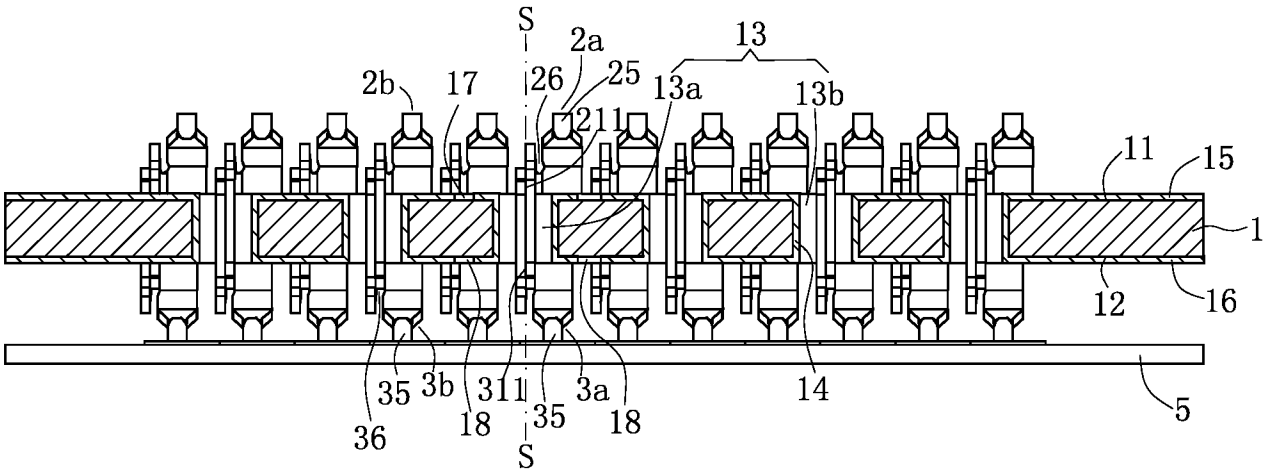
FIG. 5 is a sectional view of FIG. 3 along line B-B.
Figure 9:
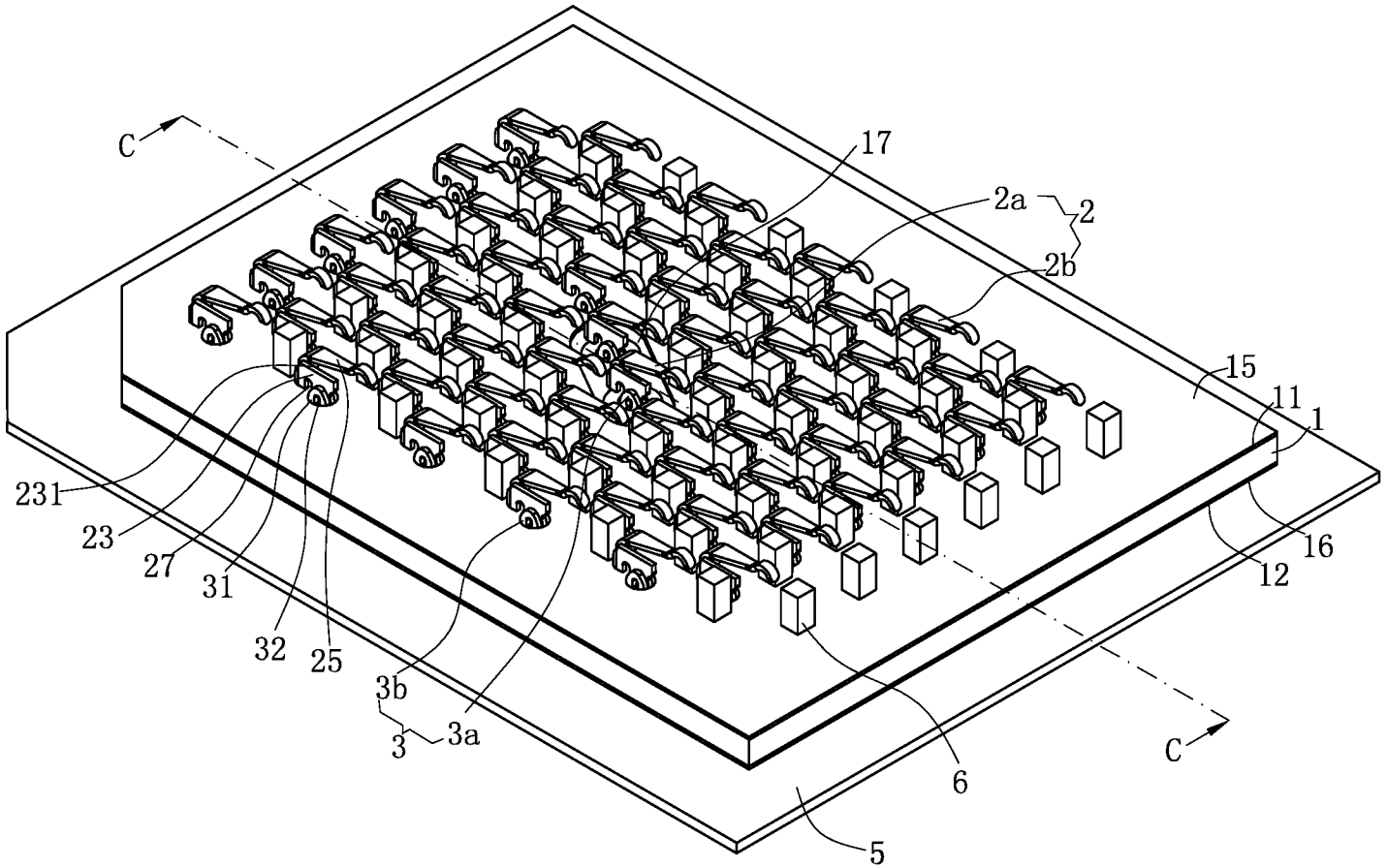
FIG. 9 is a perspective assembly view of an electrical connector according to a second embodiment of the present invention.
Figure 10:
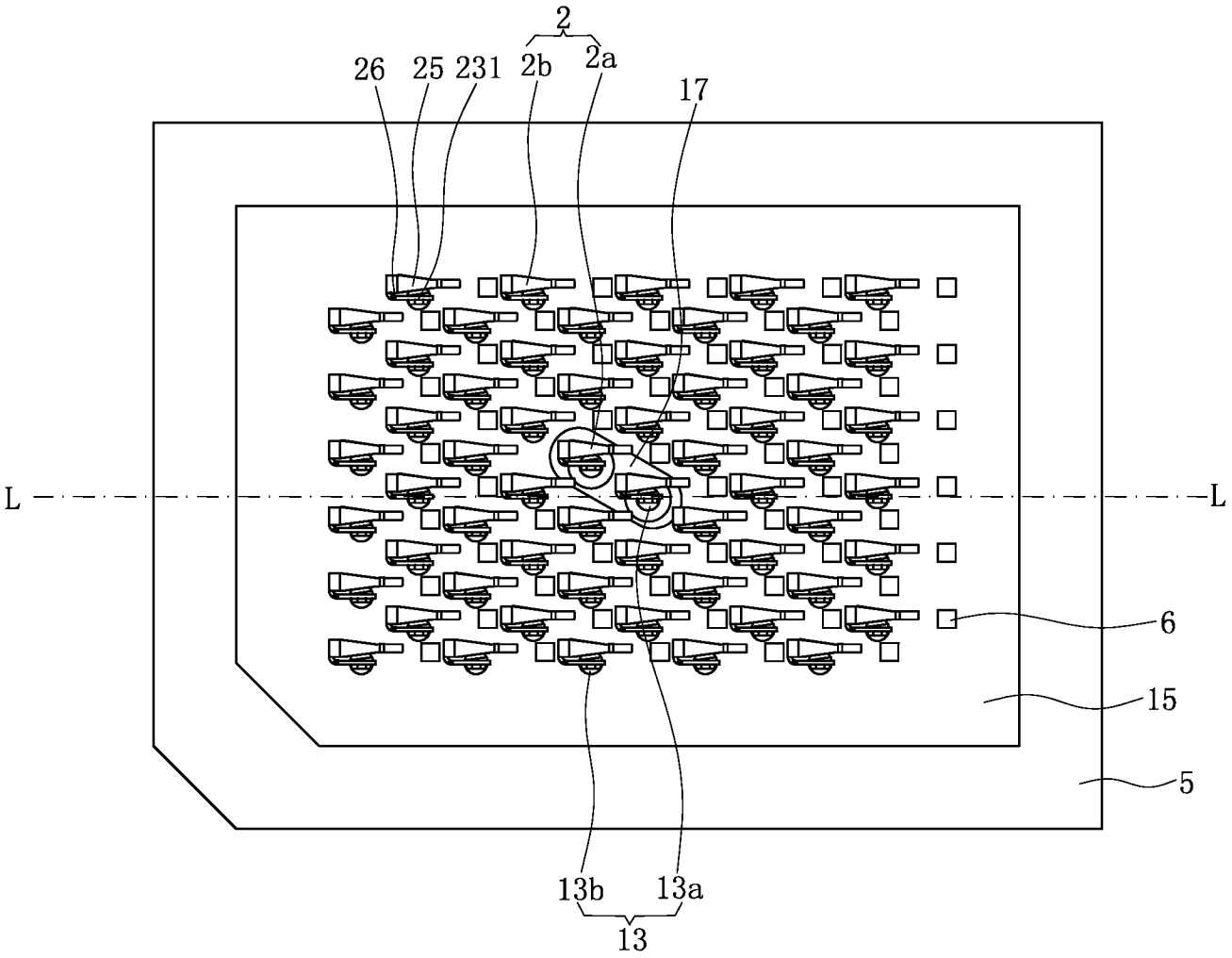
FIG. 10 is a top view of FIG. 9.
Figure 11:
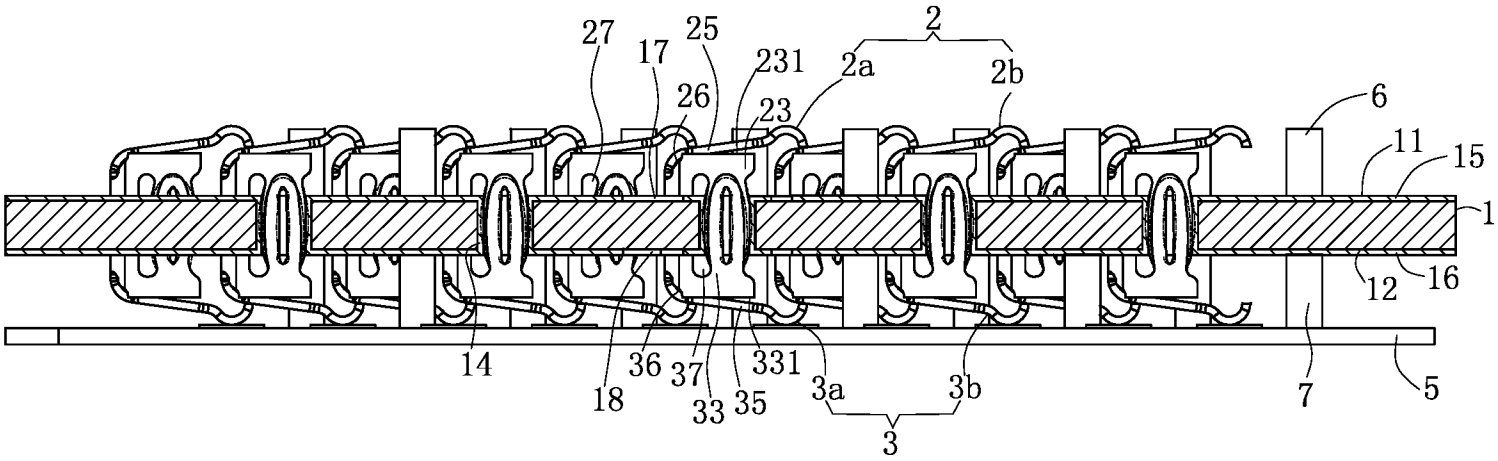
FIG. 11 is a sectional view of FIG. 9 along line C-C.
Figure 12:
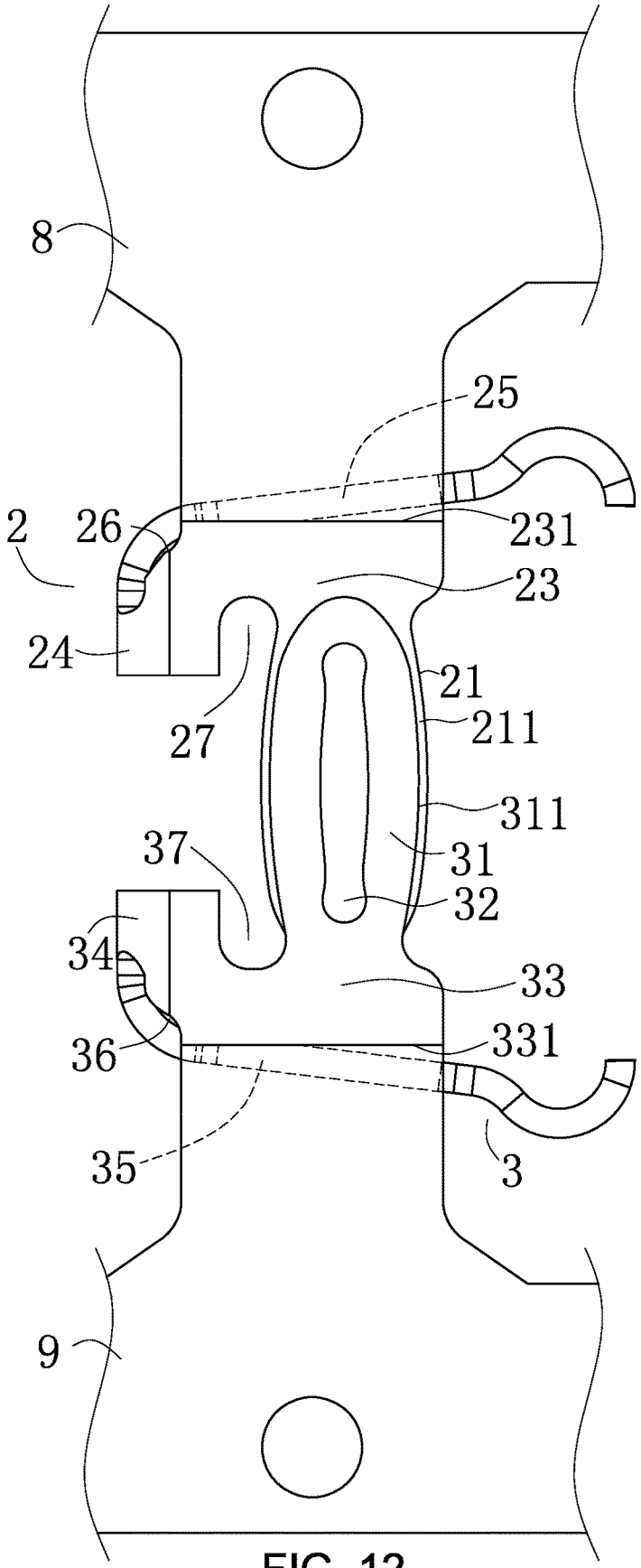
FIG. 12 is an assembly view of a first terminal and a second terminal of the electrical connector according to the second embodiment of the present invention.

As shown in FIG. 1, FIG. 5 and FIG. 9, each second terminal 3 has a second fixing portion 31 located in the corresponding accommodating hole 13. The second fixing portion 31 is in contact with the conductive layer 14. A maximum width of the second fixing portion 31 is greater than the diameter of the corresponding accommodating hole 13 such that the second fixing portion 31 is in interference fit with the corresponding accommodating hole 13 to retain the second terminal 3 in the corresponding accommodating hole 13. A rear plate surface of the second fixing portion 31 forms a second laminated surface 311 parallel to the first laminated surface 211. The second laminated surface 311 is laminated with the first laminated surface 211 along the front-rear direction. The first fixing portion 21 and the second fixing portion 31 have an identical width and are located respectively at two opposite sides of a vertical center plane S of the corresponding accommodating hole 13. A second through hole 32 runs through a thickness direction of the second fixing portion 31 in the front-rear direction, that is, the second through hole 32 runs through front and rear plate surfaces of the second fixing portion 31, thus improving elasticity of the second fixing portion 31. The second through hole 32 is partially out of the corresponding accommodating hole 13 to be exposed to the upper surface 11 and the lower surface 12. The first through hole 22 and the second through hole 32 are in communication with each other. When the first fixing portion 21 and the second fixing portion 31 are inserted into the corresponding accommodating hole 13 to be in interference fit with the inner wall of the corresponding accommodating hole 13, both of the first fixing portion 21 and the second fixing portion 31 are elastically deformed such that the widths of the first through hole 22 and the second through hole 32 are reduced (as shown in FIG. 4). A second flat plate portion 33 extends downward from the second fixing portion 31 and is located below the corresponding accommodating hole 13, and the second fixing portion 31 and the second flat plate portion 33 are located on a same plane. A lower end of the second flat plate portion 33 forms a second strip connecting end 331 to be connected to a second strip 9 (as shown in FIG. 8). The second strip connecting end 331 is located right below the second fixing portion 31, and a width of the second strip connecting end 331 right below the second fixing portion 31 is greater than the maximum width of the second fixing portion 31. A second bending portion 34 is formed by bending backward from a left side of the second flat plate portion 33. The second bending portion 34 is located below the lower surface 12. A second elastic arm 35 is formed by extending from the second bending portion 34 toward a right side of the second flat plate portion 33, such that both of the second elastic arm 35 and the second laminated surface 311 are located at a rear side of the second fixing portion 31. The second elastic arm 35 is located below the corresponding accommodating hole 13, and downward abuts the second mating component 5. An extending direction of the second elastic arm 35 and an extending direction of the first elastic arm 25 are identical (that is, the extending directions of the first elastic arm 25 and the second elastic arm 35 are both rightward from left thereof). The second elastic arm 35 and the second flat plate portion 33 partially overlap with each other in the front-rear direction. A second reserve slot 36 is formed at one side (i.e., the left side) of the second flat plate portion 33 connected with the second bending portion 34 to be reserved for the second elastic arm 35. The second flat plate portion 33 is provided with a second through slot 37 at the right side of the second bending portion 34 to improve elasticity of the second elastic arm 35. A height of the second through hole 32, a height of the second through slot 37 and a height of the second bending portion 34 partially overlap with one another.

As shown in FIG. 1 to FIG. 3, the first terminals 2 include multiple first signal terminals 2*a* and multiple first ground terminals 2*b*. The first signal terminals 2*a* and the first ground terminals 2*b* have identical structures, and are all in contact with the conductive layers 14 of the inner walls of the accommodating holes 13. The accommodating holes 13 include multiple signal accommodating holes 13*a* accommodating the first signal terminals 2*a* and multiple ground accommodating holes 13*b* accommodating the first ground terminals 2*b*. The first metal layer 15 is electrically connected with the conductive layers 14 of the inner walls of the ground accommodating holes 13*b* to form an effect that the first terminals 2*b* are connected in parallel, thereby reducing grounding inductance thereof. The upper surface 11 is provided with a first isolation slot 17 surrounding the signal accommodating holes 13*a* to electrically isolate the conductive layers 14 of the inner walls of the signal accommodating holes 13*a* from one another, thus preventing the first signal terminals 2*a* from short-circuiting. The second terminals 3 include multiple second signal terminals 3*a* and multiple second ground terminals 3*b*. The second signal terminals 3*a* and the second ground terminals 3*b* have identical structures, and are all in contact with the conductive layers 14 of the inner walls of the accommodating holes 13. The second signal terminals 3*a* are correspondingly accommodated in the signal accommodating holes 13*a*, and the second ground terminals 3*b* are correspondingly accommodated in the ground accommodating holes 13*b*. The second metal layer 16 is electrically connected with the conductive layers 14 of the inner walls of the ground accommodating holes 13*b* to form an effect that the second ground terminals 3*b* are connected in parallel, thereby reducing grounding inductance thereof. The lower surface 12 is provided with a second isolation slot 18 surrounding the signal accommodating holes 13*a* to electrically isolate the conductive layers 14 of the inner walls of the signal accommodating holes 13*a* from one another, thus preventing the second signal terminals 2*b* from short-circuiting.

FIG. 9 to FIG. 12 show an electrical connector 100 according to a second embodiment of the present invention, which is different from the first embodiment in that the first fixing portion 21 and the second fixing portion 31 have different widths. In the present embodiment, the width of the first fixing portion 21 is greater than the width of the second fixing portion 31, and a virtual center line L of the accommodating hole 13 passes through the first fixing portion 21. In other embodiments, the width of the second fixing portion 31 may be greater than the width of the first fixing portion 21, and the virtual center line L of the accommodating hole 13 may pass through the second fixing portion 31. The substrate 1 is provided with multiple first insulating protruding blocks 6 protruding upward to support the first mating component, and the substrate 1 is provided with multiple second insulating protruding blocks 7 protruding downward to abut the second mating component 5. Other structures and functions of the second embodiment are completely identical to those in the first embodiment, and are thus not elaborated herein.

Figure 13:
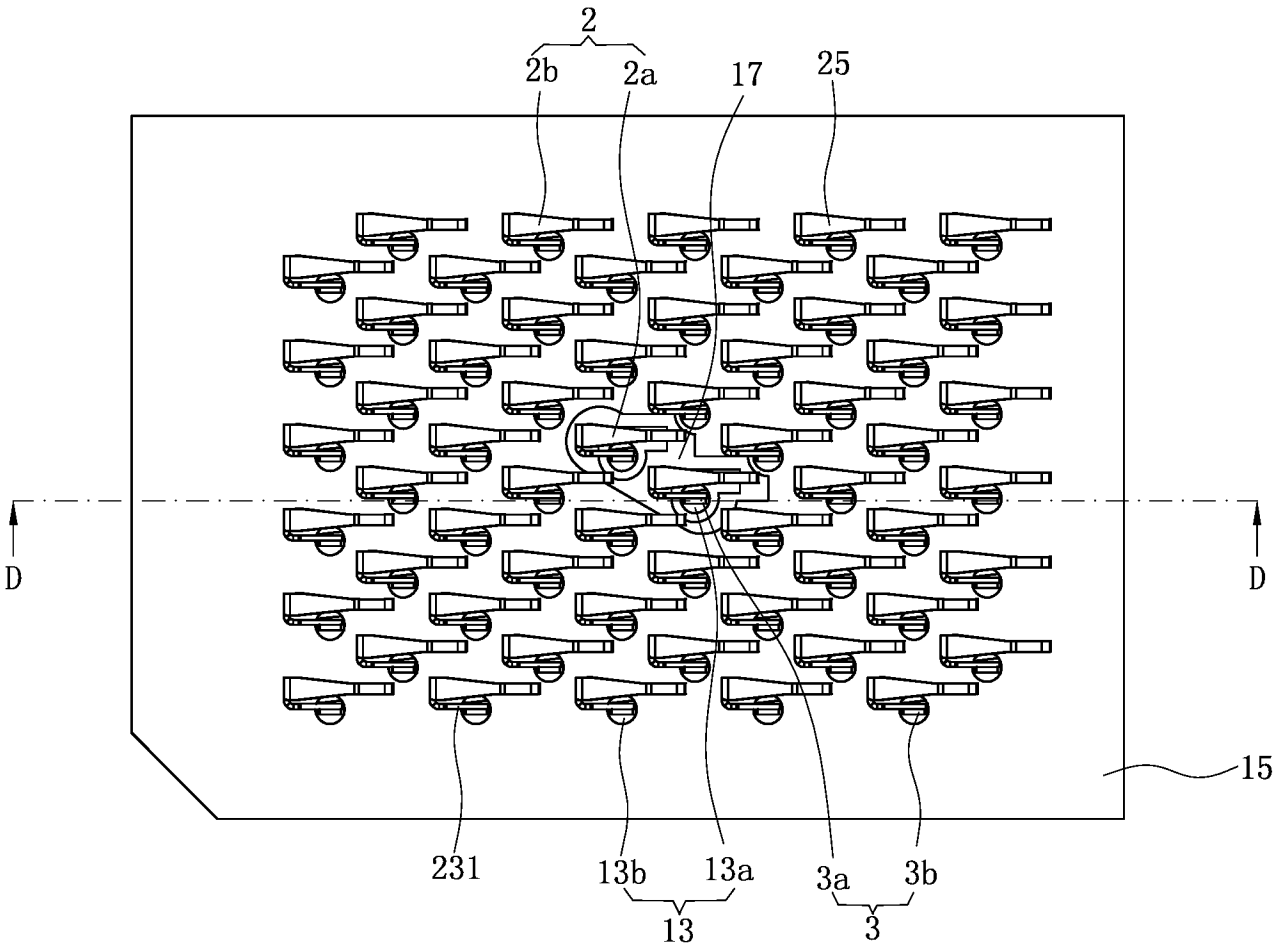
FIG. 13 is a top view of an electrical connector according to a third embodiment of the present invention.
Figure 14:
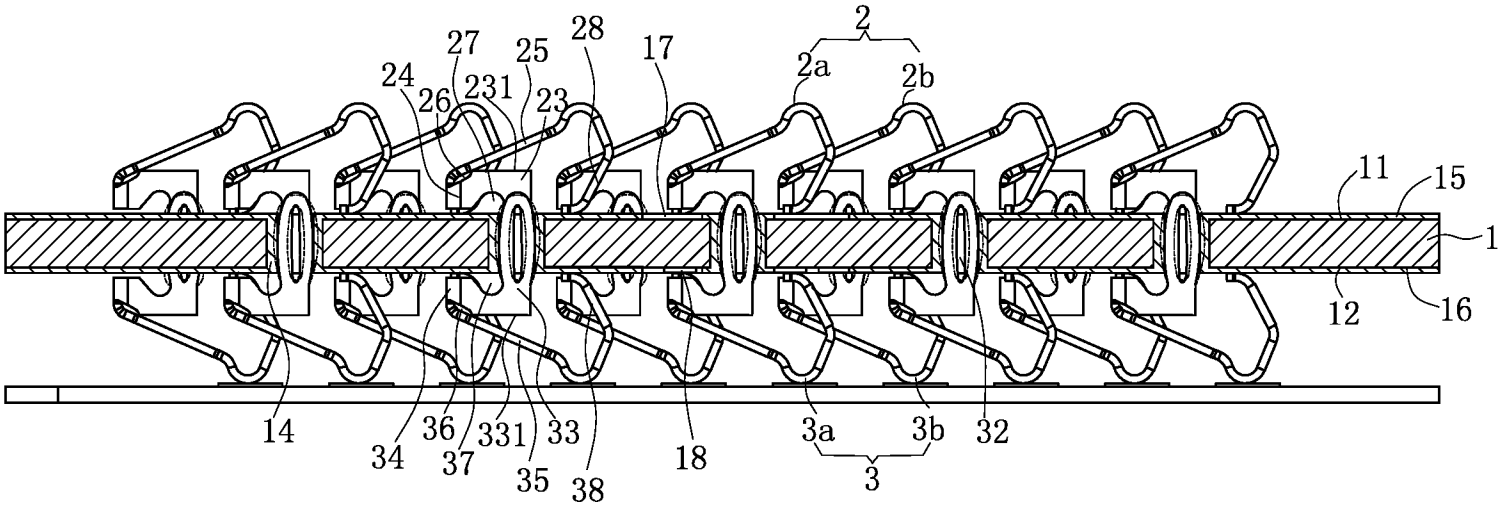
FIG. 14 is a sectional view of FIG. 13 along line D-D.
Figure 15:
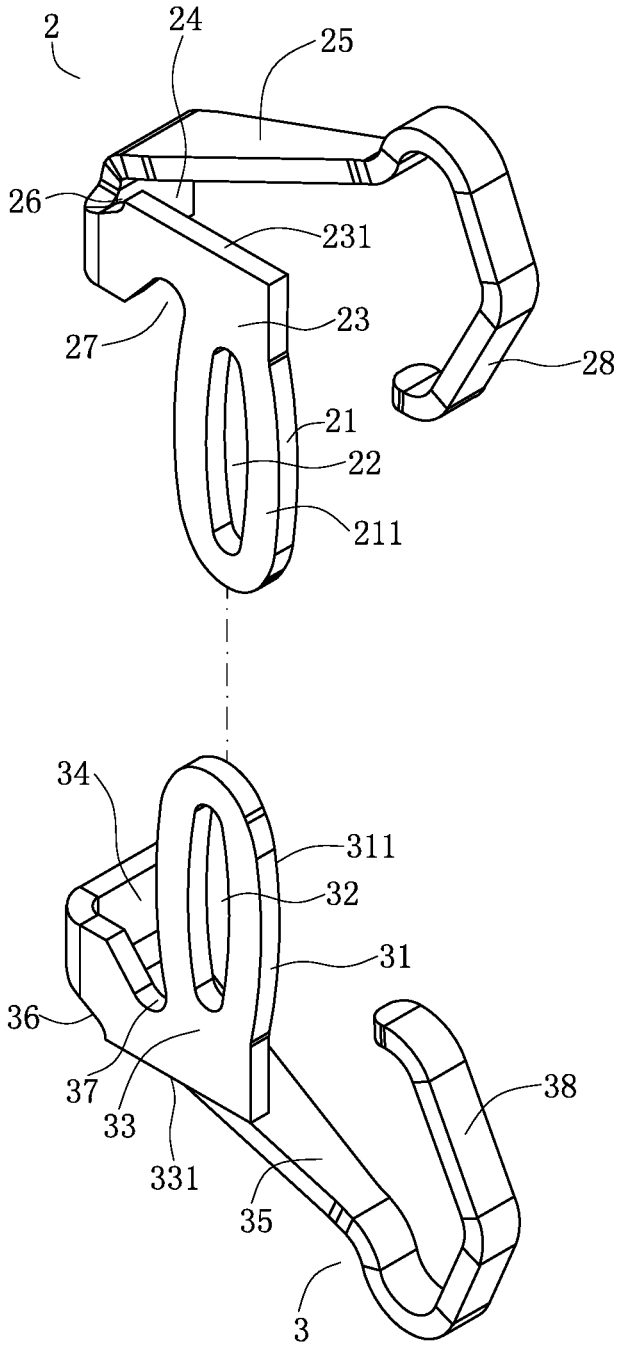
FIG. 15 is a perspective exploded view of a first terminal and a second terminal of the electrical connector according to the third embodiment of the present invention.

FIG. 13 to FIG. 15 show an electrical connector 100 according to a third embodiment of the present invention, which is different from the first embodiment in that a first abutting arm 28 is formed by bending downward and extending from the first elastic arm 25 to downward abut the first metal layer 15, and a second abutting arm 38 is formed by bending upward and extending from the second elastic arm 35 to upward abut the second metal layer 16. Other structures and functions of the second embodiment are completely identical to those in the first embodiment, and are thus not elaborated herein.

Figure 16:
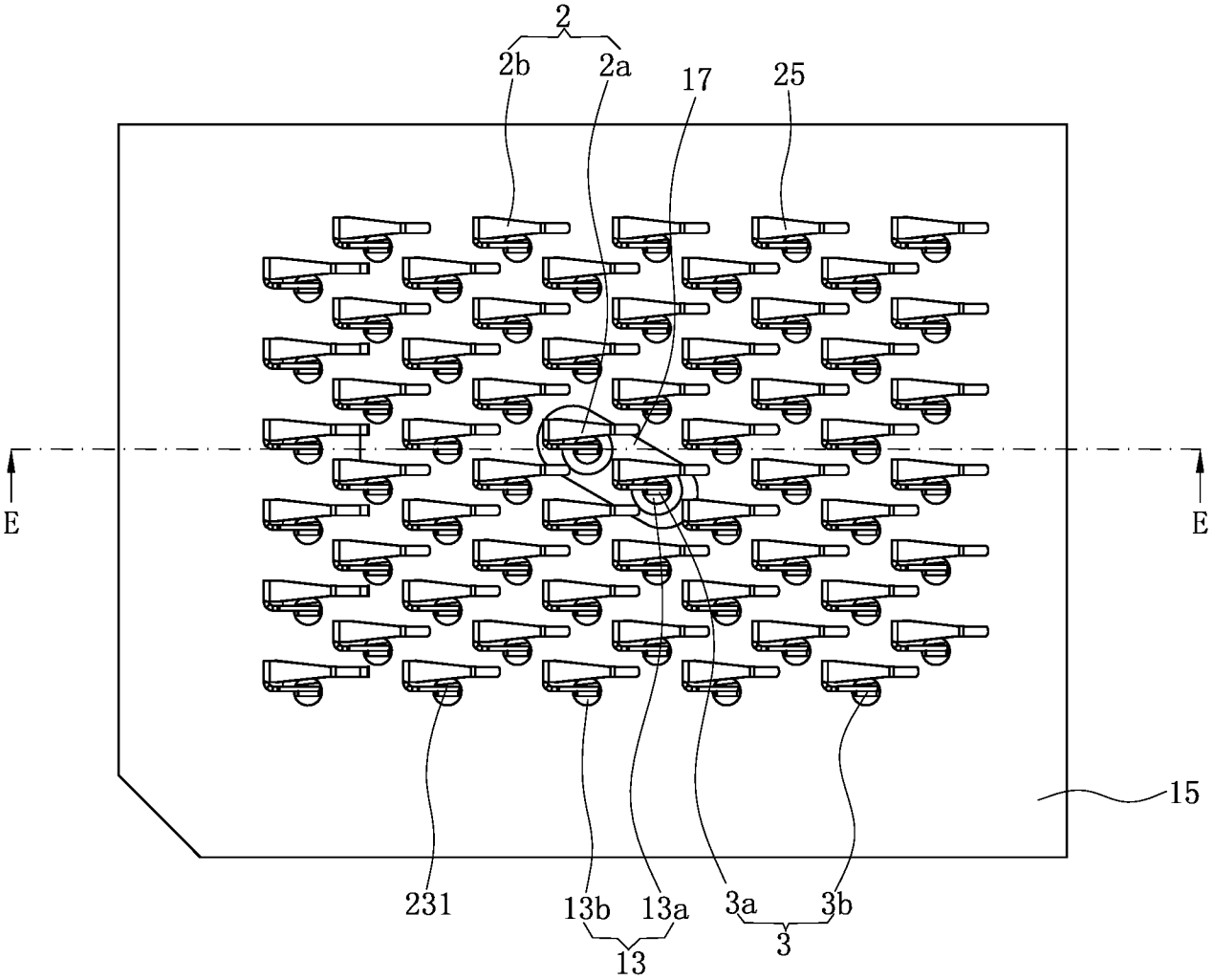
FIG. 16 is a top view of an electrical connector according to a fourth embodiment of the present invention.
Figure 17:
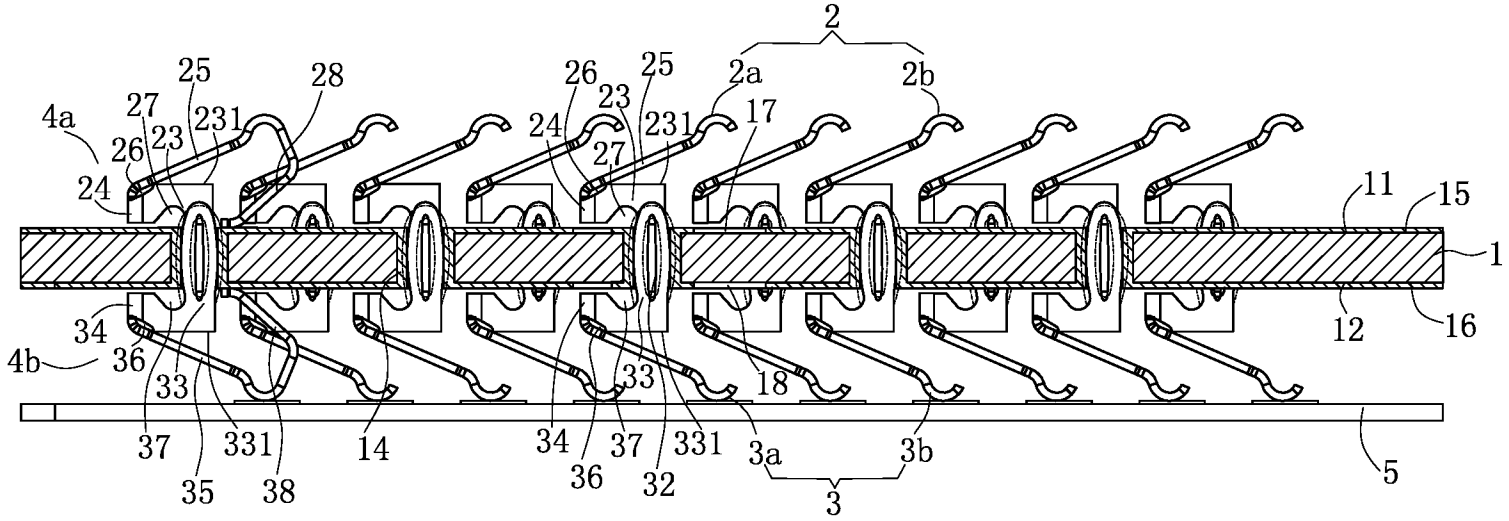
FIG. 17 is a sectional view of FIG. 16 along line E-E.

FIG. 16 and FIG. 17 show an electrical connector 100 according to a fourth embodiment of the present invention, which is different from the first embodiment in that the first terminals 2 further include multiple first power terminals 4*a*. The structures of the first power terminals 4*a* are identical to those of the first terminals 2 in the third embodiment. The first power terminals 4*a* are in contact with the conductive layers 14 of the accommodating holes 13 in which the first power terminals 4*a* are located. The second terminals 3 further include multiple third power terminals 4*b*. The structures of the second power terminals 4*b* are identical to those of the second terminals 3 in the third embodiment. The second power terminals 4*b* are in contact with the conductive layers 14 of the accommodating holes 13 in which the second power terminals 4*b* are located. The first metal layer 15 is electrically connected with the conductive layers 14 of the inner walls of the accommodating holes 13 in which the first power terminals 4*a* are located to connect the first power terminals 4*a* together, and the second metal layer 16 is electrically connected with the conductive layers 14 of the inner walls of the accommodating holes 13 in which the multiple second power terminals 4*b* are located to connect the second power terminals 4*b* together in series, such that transmission of a large current may be implemented. Other structures and functions of the second embodiment are completely identical to those in the first embodiment, and are thus not elaborated herein.

Figure 18:
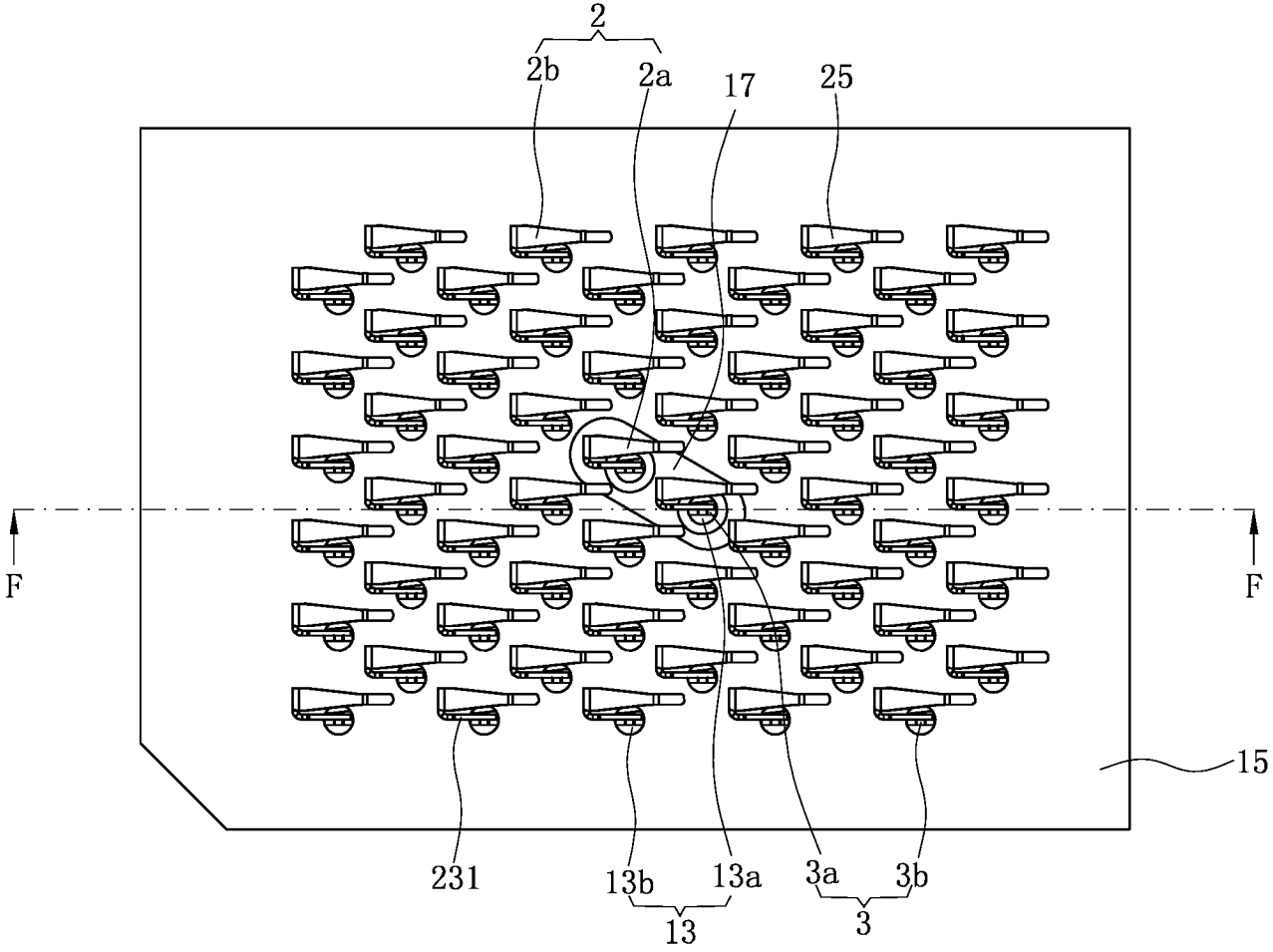
FIG. 18 is a top view of an electrical connector according to a fifth embodiment of the present invention.
Figure 19:
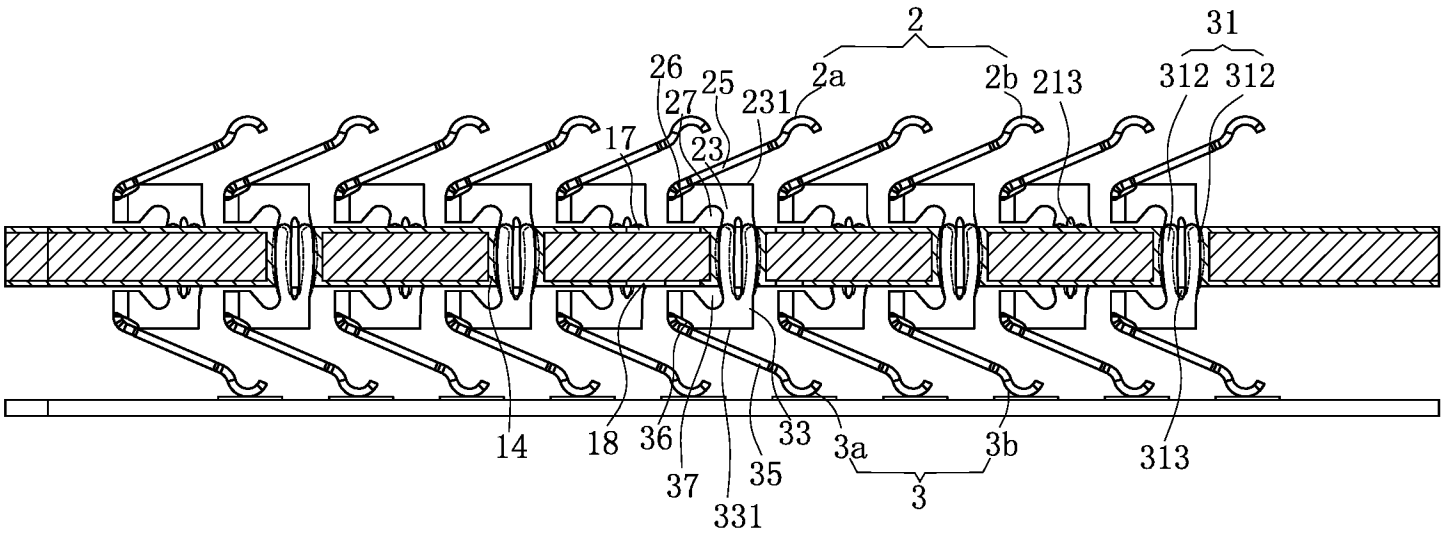
FIG. 19 is a sectional view of FIG. 18 along line F-F.
Figure 20:
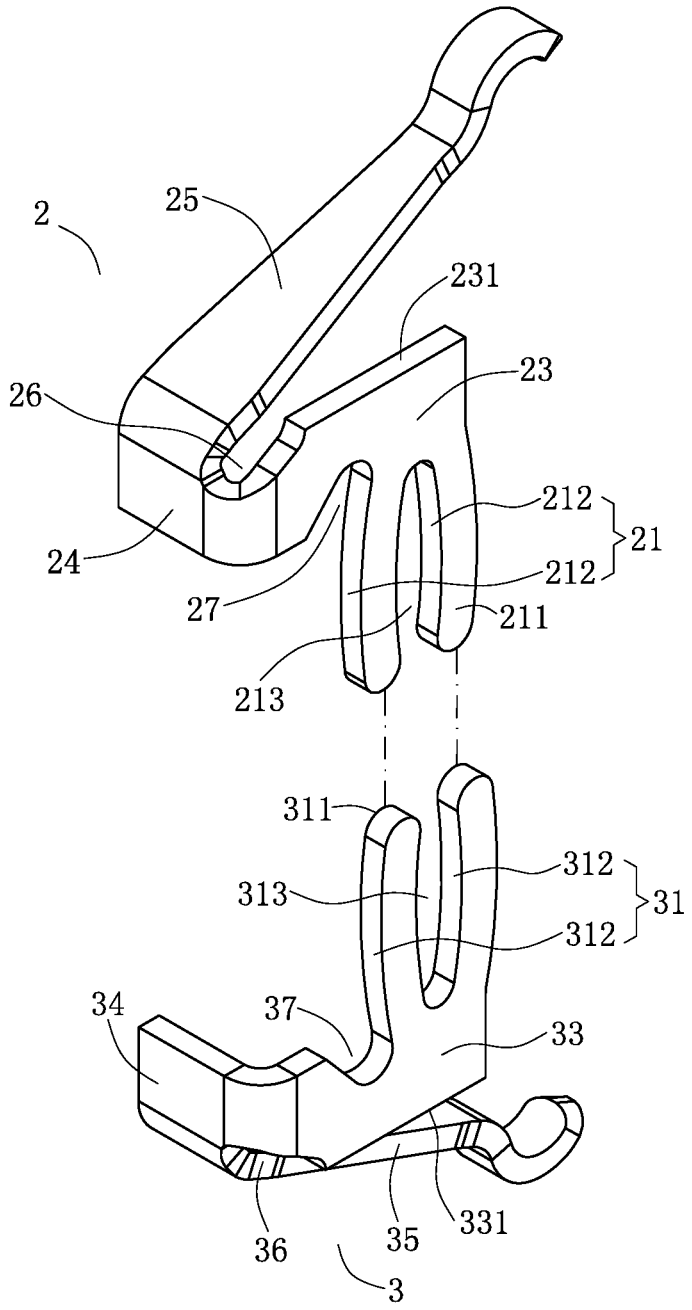
FIG. 20 is a perspective exploded view of a first terminal and a second terminal of the electrical connector according to the fifth embodiment of the present invention.

FIG. 18 to FIG. 20 show an electrical connector 100 according to a fifth embodiment of the present invention, which is different from the first embodiment in that the first fixing portion 21 includes two first branches 212 connected to the first flat plate portion 23, a first gap 213 is formed between the two first branches 212, and the two first branches 212 abut the inner wall of the corresponding accommodating hole 13 altogether. The second fixing portion 31 includes two second branches 312 connected to the second flat plate portion 33, a second gap 313 is formed between the two second branches 312, the first gap 213 and the second gap 313 are in communication with each other, and the two second branches 312 abut the inner wall of the accommodating hole 13 altogether, such that an insertion force during insertion of the first terminals 2 and the second terminals 3 into the accommodating holes 13 is relatively low. Other structures and functions of the second embodiment are completely identical to those in the first embodiment, and are thus not elaborated herein.

Figure 21:
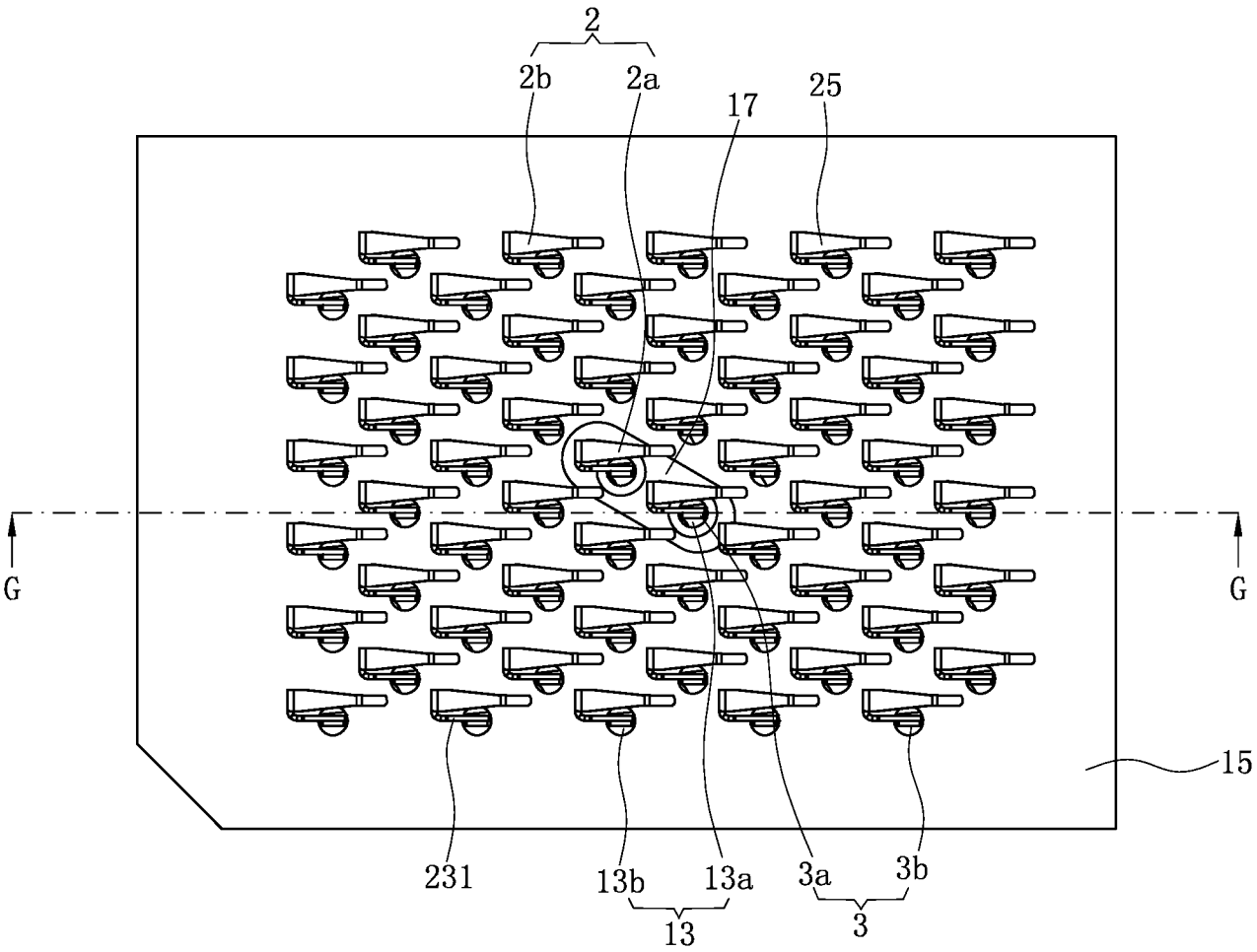
FIG. 21 is a top view of an electrical connector according to a sixth embodiment of the present invention.
Figure 22:
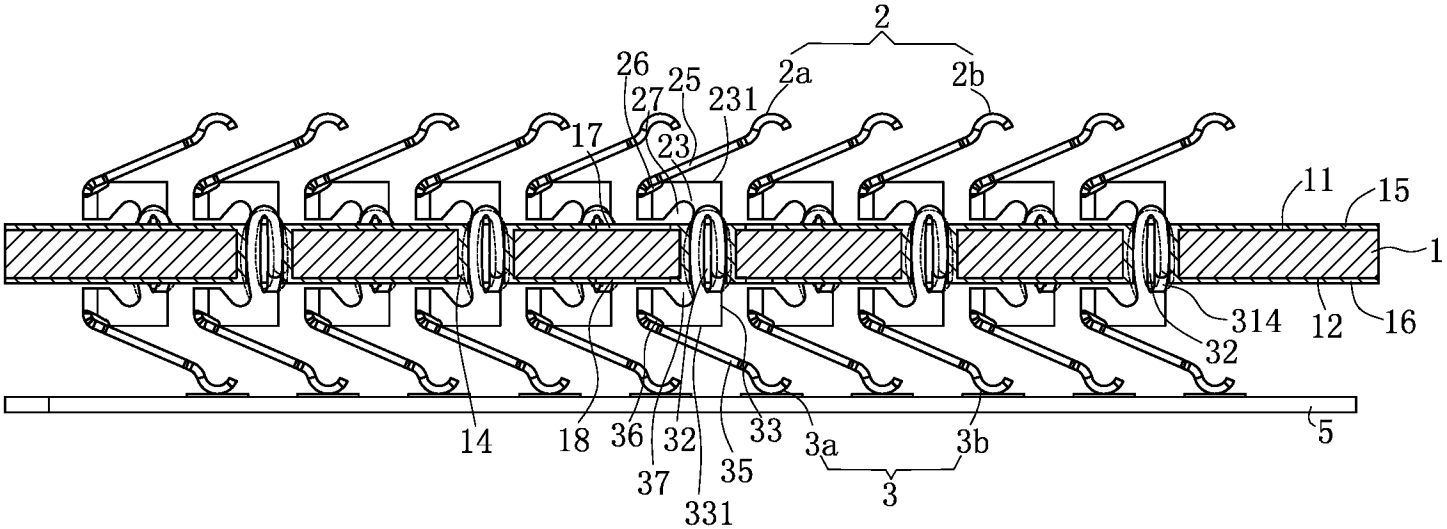
FIG. 22 is a sectional view of G-G in FIG. 21 along line G-G.
Figure 23:
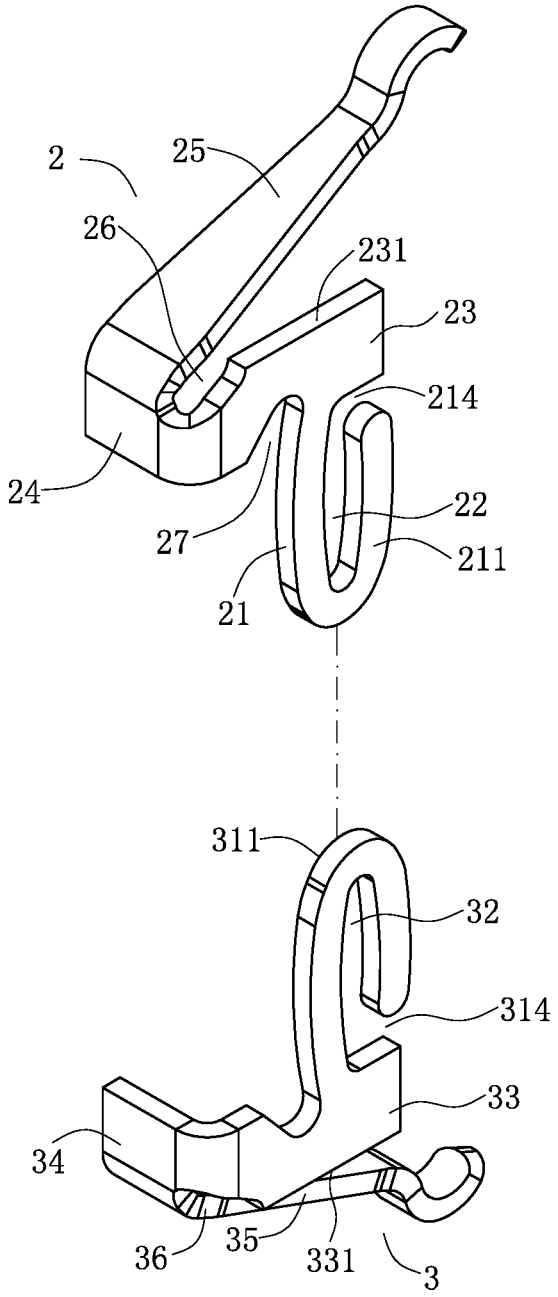
FIG. 23 is a perspective exploded view of a first terminal and a second terminal of the electrical connector according to the sixth embodiment of the present invention.

FIG. 21 to FIG. 23 show an electrical connector 100 according to a sixth embodiment of the present invention, which is different from the first embodiment in that the first fixing portion 21 is further provided with a first notch 214 in communication with the first through hole 22 and running through a side edge of the first fixing portion 21, and the first notch 214 is located at an upper right side of the first fixing portion 21, such that the first fixing portion 21 is disconnected from the first flat plate portion 23 at the first notch 214. The second fixing portion 31 is further provided with a second notch 314 in communication with the second through hole 32 and running through a side edge of the second fixing portion 31, and the second notch 314 is located at a lower right side of the second fixing portion 31, such that the first notch 214 and the second notch 314 are provided vertically and located at the same side of the first through hole 22. The second fixing portion 31 is disconnected from the second flat plate portion 33 at the second notch 314, such that the first fixing portion 21 and the second fixing portion 31 are relatively high in elasticity and the insertion force during insertion into the accommodating hole 13 is relatively low. Other structures and functions of the second embodiment are completely identical to those in the first embodiment, and are thus not elaborated herein.

To sum up, the electrical connector 100 according to certain embodiments of the present invention has the following beneficial effects:

(1) A plate surface of the first fixing portion 21 forms the first laminated surface 211, and a plate surface of the second fixing portion 31 forms the second laminated surface 311 parallel to the first laminated surface 211. The second laminated surface 311 is laminated with the first laminated surface 211 along the horizontal direction, such that an open stub effect during high-frequency signal transmission of the first terminal 2 and the second terminal 3 may be resolved, and the electrical connector 100 is endowed with good high-frequency performance.

(2) The first elastic arm 25 and the first laminated surface 211 are located at two opposite sides of the first fixing portion 21, and the second elastic arm 35 and the second laminated surface 311 are located at the same side of the second fixing portion 31. That is, the first elastic arm 25 and the second elastic arm 35 are located at the same side of the first laminated surface 211, such that a distance between the first elastic arm 25 and the second elastic arm 35 in the horizontal direction is relatively short, thereby allowing two adjacent first terminals 2 to be arranged more densely, and two adjacent second terminals 3 to be arranged more densely.

(3) The first metal layer 15 is electrically connected with the conductive layers 14 of the inner walls of the ground accommodating holes 13*b* to form an effect that the first terminals 2*b* are connected in parallel, and the second metal layer 16 is electrically connected with the conductive layers 14 of the inner walls of the ground accommodating holes 13*b* to form an effect that the second ground terminals 3*b* are connected in parallel, thereby reducing grounding inductance thereof, and improving the high-frequency performance.

(4) For the signal terminals, the first abutting arm 28 is formed by extending from the first elastic arm 25 to abut the first metal layer 15, and the second abutting arm 38 is formed by extending from the second elastic arm 35 to abut the second metal layer 16, thus forming two conductive paths between the first mating component and the second mating component 5, such that the high-frequency performance of the electrical connector 100 may be improved.

(5) The first metal layer 15 is electrically connected with the conductive layers 14 of the inner walls of the accommodating holes 13 in which the first power terminals 4*a* are located to connect the first power terminals 4*a* together in series, and the second metal layer 16 is electrically connected with the conductive layers 14 of the inner walls of the accommodating holes 13 in which the second power terminals 4*b* are located to connect the second power terminals 4*b* together in series, such that transmission of a large current may be implemented.

(6) The first fixing portion 21 includes two first branches 212, and a first gap 213 is formed between the two first branches 212. The second fixing portion 31 includes two second branches 312, and a second gap 313 is formed between the two second branches 312, such that the insertion force during insertion of the first terminals 2 and the second terminals 3 into the accommodating holes 13 is relatively low. The first fixing portion 21 is provided with the first notch 214 in communication with the first through hole 22 and running through the side edge of the first fixing portion 21, and the second fixing portion 31 is provided with the second notch 314 in communication with the second through hole 32 and running through the side edge of the second fixing portion 31, such that the first fixing portion 21 and the second fixing portion 31 are relatively high in elasticity, and the insertion force during insertion into the accommodating holes 13 is relatively low.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a first mating component to a second mating component, the electrical connector comprising:

a substrate, provided with an accommodating hole;

a first terminal, having a first elastic arm located outside the accommodating hole and abutting the first mating component along a vertical direction, and a first fixing portion retained in the accommodating hole, wherein a plate surface of the first fixing portion forms a first laminated surface, and the first elastic arm and the first laminated surface are located at two opposite sides of the first fixing portion; and a second terminal, provided vertically with the first terminal, wherein the second terminal has a second elastic arm located outside the accommodating hole and abutting the second mating component along the vertical direction, and a second fixing portion retained in the accommodating hole, a plate surface of the second fixing portion forms a second laminated surface parallel to the first laminated surface, the second laminated surface is laminated with the first laminated surface along a horizontal direction, and the second elastic arm and the second laminated surface are located at a same side of the second fixing portion.

2. The electrical connector according to claim 1, wherein:

a first flat plate portion extends from the first fixing portion and is located outside the accommodating hole, the first fixing portion and the first flat plate portion are located on a same plane, one end of the first flat plate portion forms a first strip connecting end to be connected to a first strip, a first bending portion is formed by bending from one of two opposite sides of the first flat plate portion, and the first elastic arm extends from the first bending portion toward the other of the two opposite sides of the first flat plate portion; and a second flat plate portion extends from the second fixing portion and is located outside the accommodating hole, the second fixing portion and the second flat plate portion are located on a same plane, one end of the second flat plate portion forms a second strip connecting end to be connected to a second strip, a second bending portion is formed by bending from one of two opposite sides of the second flat plate portion, the second elastic arm extends from the second bending portion toward the other of the two opposite sides of the second flat plate portion, and an extending direction of the first elastic arm and an extending direction of the second elastic arm are identical.

3. The electrical connector according to claim 2, wherein the first elastic arm and the first flat plate portion partially overlap with each other in the horizontal direction, and a first reserve slot is formed at the side of the first flat plate portion connected with the first bending portion to reserve for the first elastic arm.

4. The electrical connector according to claim 2, wherein the first strip connecting end is located right above the first fixing portion, and a width of the first strip connecting end right above the first fixing portion is greater than a maximum width of the first fixing portion.

5. The electrical connector according to claim 2, wherein the first fixing portion is provided with a first through hole running through a thickness direction of the first fixing portion, the first through hole partially extends out of the accommodating hole, the first flat plate portion is provided with a first through slot located between the first through hole and the first bending portion, and a height of the first through hole, a height of the first through slot and a height of the first bending portion partially overlap with one another.

6. The electrical connector according to claim 1, wherein both of the first fixing portion and the second fixing portion are in interference fit with the accommodating hole, the first fixing portion is provided with a first through hole running through a thickness direction of the first fixing portion, the second fixing portion is provided with a second through hole running through a thickness direction of the second fixing portion, and the first through hole and the second through hole are in communication with each other.

7. The electrical connector according to claim 6, wherein the first fixing portion is further provided with a first notch in communication with the first through hole and running through a side edge of the first fixing portion, the second fixing portion is further provided with a second notch in communication with the second through hole and running through a side edge of the second fixing portion, and the first notch and the second notch are provided vertically and located at a same side of the first through hole.

8. The electrical connector according to claim 1, wherein the first fixing portion comprises two first branches, a first gap is formed between the two first branches, the second fixing portion comprises two second branches, a second gap is formed between the two second branches, and the first gap and the second gap are in communication with each other.

9. The electrical connector according to claim 1, comprising a plurality of first terminals, wherein the first terminals comprise a plurality of signal terminals and a plurality of ground terminals, the substrate is a circuit board and is provided with a plurality of accommodating holes comprising a plurality of signal accommodating holes accommodating the signal terminals and a plurality of ground accommodating holes accommodating the ground terminals, inner walls of the signal accommodating holes and inner walls of the ground accommodating holes have conductive layers respectively in contact with the signal terminals and the ground terminals correspondingly, a surface of the circuit board has a metal layer being grounded, the metal layer is electrically connected with the conductive layers of the inner walls of the ground accommodating holes, and the surface of the circuit board has an isolation slot surrounding the signal accommodating holes to electrically isolate the conductive layers of the inner walls of the signal accommodating holes from one another.

10. The electrical connector according to claim 1, comprising a plurality of first terminals, wherein the first terminals comprise a plurality of power terminals, the substrate is provided with a plurality of accommodating holes, inner walls of the accommodating holes in which the power terminals are located have conductive layers respectively in contact with the power terminals correspondingly, the substrate has a metal layer, and the metal layer is electrically connected with the conductive layers of the inner walls of the accommodating holes in which the power terminals are located.

11. The electrical connector according to claim 1, wherein the substrate is a circuit board, two opposite surfaces of the substrate respectively have a first metal layer and a second metal layer, an inner wall of the accommodating hole is provided with a conductive layer connected with the first metal layer and the second metal layer, a first abutting arm is formed from the first elastic arm to abut the first metal layer, and a second abutting arm is formed from the second elastic arm to abut the second metal layer.

12. The electrical connector according to claim 1, wherein the first fixing portion and the second fixing portion are located at two opposite sides of a vertical center plane of the accommodating hole.

13. The electrical connector according to claim 1, wherein the first fixing portion and the second fixing portion have different widths, and a virtual center line of the accommodating hole passes through one of the first fixing portion and the second fixing portion.

* * * * *